US006766130B2

(12) United States Patent
Song et al.

(10) Patent No.: US 6,766,130 B2
(45) Date of Patent: Jul. 20, 2004

(54) LIQUID DEVELOPER IMAGING SYSTEM

(75) Inventors: In-yong Song, Suwon-si (KR); Kyu-cheol Shin, Gwacheon-si (KR); Kwang-ho No, Suwon-si (KR); Hyun-seong Shin, Suwon-si (KR); Geun-yong Park, Suwon-si (KR); Jong-woo Kim, Suwon-si (KR); Seung-young Byun, Seongnam-si (KR); Joong-gwang Shin, Suwon-si (KR); Sam-seuk Choi, Suwon-si (KR); Yong-su Kim, Yongin-si (KR); Woo-yong Park, Suwon-si (KR); Jun-hee Cho, Yongin-si (KR); Wan-ha Kim, Suwon-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/142,949

(22) Filed: May 13, 2002

(65) Prior Publication Data

US 2003/0044202 A1 Mar. 6, 2003

(30) Foreign Application Priority Data

Aug. 30, 2001 (KR) ..... 10-2001-52957

(51) Int. Cl.[7] ..... G03G 15/10
(52) U.S. Cl. ..... 399/238; 399/240
(58) Field of Search ..... 399/57, 233, 235, 399/237–240

(56) References Cited

U.S. PATENT DOCUMENTS 3,368,894 A * 2/1968 Matkan et al. ..... 399/239
3,601,092 A * 8/1971 Satomi ..... 399/240
3,973,699 A * 8/1976 Cook ..... 222/DIG. 1
4,264,191 A * 4/1981 Gerbasi et al. ..... 399/239
5,596,398 A * 1/1997 Woo et al. ..... 399/346
5,915,150 A * 6/1999 Kukimoto et al. ..... 399/249
6,088,560 A * 7/2000 Zenk et al. ..... 399/237
6,108,508 A * 8/2000 Takeuchi et al. ..... 399/238
6,167,225 A * 12/2000 Sasaki et al. ..... 399/43
6,311,035 B1 * 10/2001 Liu et al. ..... 399/240
6,324,368 B1 * 11/2001 Seto ..... 399/237
6,339,686 B2 * 1/2002 Yamanaka et al. ..... 399/237
6,353,721 B1 * 3/2002 Yamaguchi et al. ..... 399/237
6,415,124 B1 * 7/2002 Nishikawa ..... 399/237

FOREIGN PATENT DOCUMENTS

JP 63074083 A * 4/1988 ..... G03G/15/10
JP 7-239614 A1 9/1995
JP 09185265 A * 7/1997 ..... G03G/15/10

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A liquid developer imaging system and a method using the system for developing an image, including a cartridge for containing a developing solution; a developing container for receiving the developing solution supplied from the cartridge via a predetermined supply line; a developing roller partly submerged in the developing solution contained in the developing container, installed to be rotated facing a photosensitive object; and a metering blade for scraping off the developing solution coated on the surface of the developing roller to a predetermined thickness, is provided. According to the system, a developing supply structure can be considerably simplified because a high-density developing solution is directly used in developing an image without a process of diluting the solution, and an image can be developed to have high definition because the concentration of the developing solution coated on the developing roller is regularly controlled by a metering blade.

24 Claims, 3 Drawing Sheets

LIQUID DEVELOPER IMAGING SYSTEM

BACKGROUND OF THE INVENTION

1. Field of the Invention

The present invention relates to a liquid developer imaging system and, more particularly, to a method of developing an image and to a liquid developer imaging system that has a simple structure and uses a high-density developing solution.

2. Description of the Related Art

In a general liquid developer imaging system, light is scanned onto a photosensitive object to form an electrostatic latent image corresponding to a desired image. Next, the obtained electrostatic latent image is developed with a developing solution that is a mixture of powdered toner and a liquid solvent. Then, the developed resultant is printed on paper.

FIG. 1 is a view of an example of a general liquid developer imaging system disclosed in U.S. Pat. No. 5,255,058. Referring to FIG. 1, the general liquid developer imaging system includes: a photosensitive object 10 electrically charged to a predetermined voltage level by a charger 14; an optical scanning device 16 which forms an electrostatic latent image of a desired image by scanning light onto the charged photosensitive object 10 and forming a relative voltage difference thereon; a developing solution supply unit, which supplies developing solution to the photosensitive object 10 to form the electrostatic latent image; and a transferring roller 30 that receives an image developed on the photosensitive object 10 and prints the received image on paper.

The developing solution supply unit generally supplies the developing solution including less than 3% solid toner to the portion between the photosensitive object 10 and a developing roller 38. The developing solution supply unit includes: enriched cartridges 82 and 84 containing enriched developing solution of about 25% solid; a solvent cartridge 86 containing a pure solvent; mixing tanks 55, 57, 59 and 61 that are classified according to colors and mix the developing solution and solvent in the cartridges 82, 84 and 86 to prepare the developing solution of regular concentration, e.g., 2~3% solid; a supplier 20 for pumping the developing solution prepared in the mixing tanks 55, 57, 59 and 61 by pumps 90, 92, 94 and 96, and supplying the same to the developing roller 38; and a retriever for retrieving the developing solution remaining after the development of an electrostatic latent image. The retriever includes: a collecting container 50 which collects the developing solution remaining after the developing solution is supplied to the developing roller 38 and the photosensitive object 10, and then returns the remaining developing solution to the mixing tanks 55, 57, 59 and 61; a squeezing roller 26, which compresses the photosensitive object 10 where an image is developed and squeezes the developing solution out of the developed image; and a separator 66 for retrieving the squeezed developing solution from the collecting container 50, extracting a toner and a solvent from the developing solution and supplying the extracted solvent to the solvent tank 65.

To develop an image using the above general liquid developer imaging system, four colors of developing solutions containing 2–3% solid, i.e., yellow Y, magenta M, cyan C and black K, are prepared in the mixing tanks 55, 57, 59 and 61, respectively. In the developing system, for a black and white image, only one color developing solution is required, whereas in a liquid developer imaging system, which develops color images, developing solutions of four different colors are needed. To prepare four developing solutions of different colors, the developing solution supply unit extracts enriched developing solution from the enriched cartridges 82 and 84 and a pure solvent from the solvent cartridge 86 and supplies them to the mixing tanks 55, 57, 59 and 61 to prepare developing solutions containing 2~3% solid. In general, each of the mixing tanks 55, 57, 59 and 61 includes a concentration sensor (not shown) for measuring the concentration of the mixed developing solution. When the developing solutions are prepared, an image is developed as described below.

First, while the photosensitive object 10 is charged with a predetermined electrical charge by the charger 14, light is scanned onto the charged photosensitive object 10 by the optical scanning device 16 and as a result, an electrical potential of the photosensitive object 10 is lowered, thus forming a desired electrostatic latent image. Next, the pumps 90, 92, 94 and 96 are operated to supply the developing solutions from the mixing tanks 55, 57, 59 and 61 to the region between the developing roller 38 and the photosensitive object 10, through the supplier 20, thereby developing the electrostatic latent image. Then, the developed image is transferred onto the transferring roller 30. Next, if the image is composed of one color, then the transferred image is directly printed on paper 72. However, if a desired image is a color image, the above process must be repeated for each respective color, i.e., yellow Y, magenta M, cyan C and black K, so that images developed per color are overlapped on the transferring roller 30 forming a color image. Thereafter, the formed color image is printed on paper 72, which passes all the way through and between the transferring roller 30 and a compressing roller 71.

Such a general liquid developer imaging system is not easy to use because of the complexities in preparing the developing solution, supplying the solution between a developing roller and a photosensitive object, and retrieving it. The complexity in the system is due to the fact that enriched high-density developing solution is not used directly in the general liquid developer imaging system but must be diluted to less than 3% solid by concentration. The use of diluted developing solution makes the fluidity thereof better, thus reducing regional deviation of toner density in a developed image. However, diluting developing solution makes a process of developing an image more complicated. In detail, enriched developing solution and solvent are prepared in each of the enriched cartridges 82, 84 and 86 to be supplied to the mixing tanks 55, 57, 59 and 61, mixed to have a low solid concentration of less than 3% and used to form an electrostatic latent image. Then, the solvent contained in the developed image is squeezed to be retrieved, so that the developing solution has a high concentration to be adapted to print the image. Accordingly, the general liquid developer imaging system becomes larger and more expensive to manufacture. For this reason, there is a growing need for a new liquid developer imaging system to solve this problem.

SUMMARY OF THE INVENTION

To solve the above problem, it is an aspect of the present invention to provide an improved liquid developer imaging system in which high-density developing solution can be used without squeezing a solvent from the solution.

Accordingly, to achieve the above aspect, the present invention includes a liquid developer imaging system that has a cartridge for storing a developing solution; a developing container for receiving the developing solution supplied from the cartridge via a predetermined supply line; a developing roller installed for rotating facing a photosensitive object, and partly submerged in the developing solution contained in the developing container; and metering means for scraping off developing solution coated on the surface of the developing roller to a predetermined thickness.

Furthermore, to achieve the above aspect, the present invention includes a method of developing a print image comprising of supplying a developing solution from a cartridge to a developing container by the movement of a piston for compression and expansion of a tube; applying a bias voltage to a development roller, partly submerged in the developing solution contained in the developing container, and to a deposit roller for charging particles of a toner in the developing solution; applying the bias voltage of the deposit roller to a photosensitive object by using a charging roller; scrapping off to a predetermined thickness the developing solution coated on the surface of the developing roller for controlling the concentration of the developing solution; rotating the developing roller facing the photosensitive object for transferring the developing solution onto the photosensitive object for the development of an image; moving a developed image onto a transferring belt without squeezing solvent from the developed image; and printing the image from the transferring table to a medium.

BRIEF DESCRIPTION OF THE DRAWINGS

The above aspect and advantages of the present invention will be readily apparent by describing in detail illustrative embodiments thereof with reference to the attached drawings, in which.

DETAILED DESCRIPTION OF THE ILLUSTRATIVE EMBODIMENTS

A liquid developer imaging system in accordance with illustrative and non-limiting embodiments of the present invention will now be described in detail with reference to the accompanying drawings.

Figure 1:
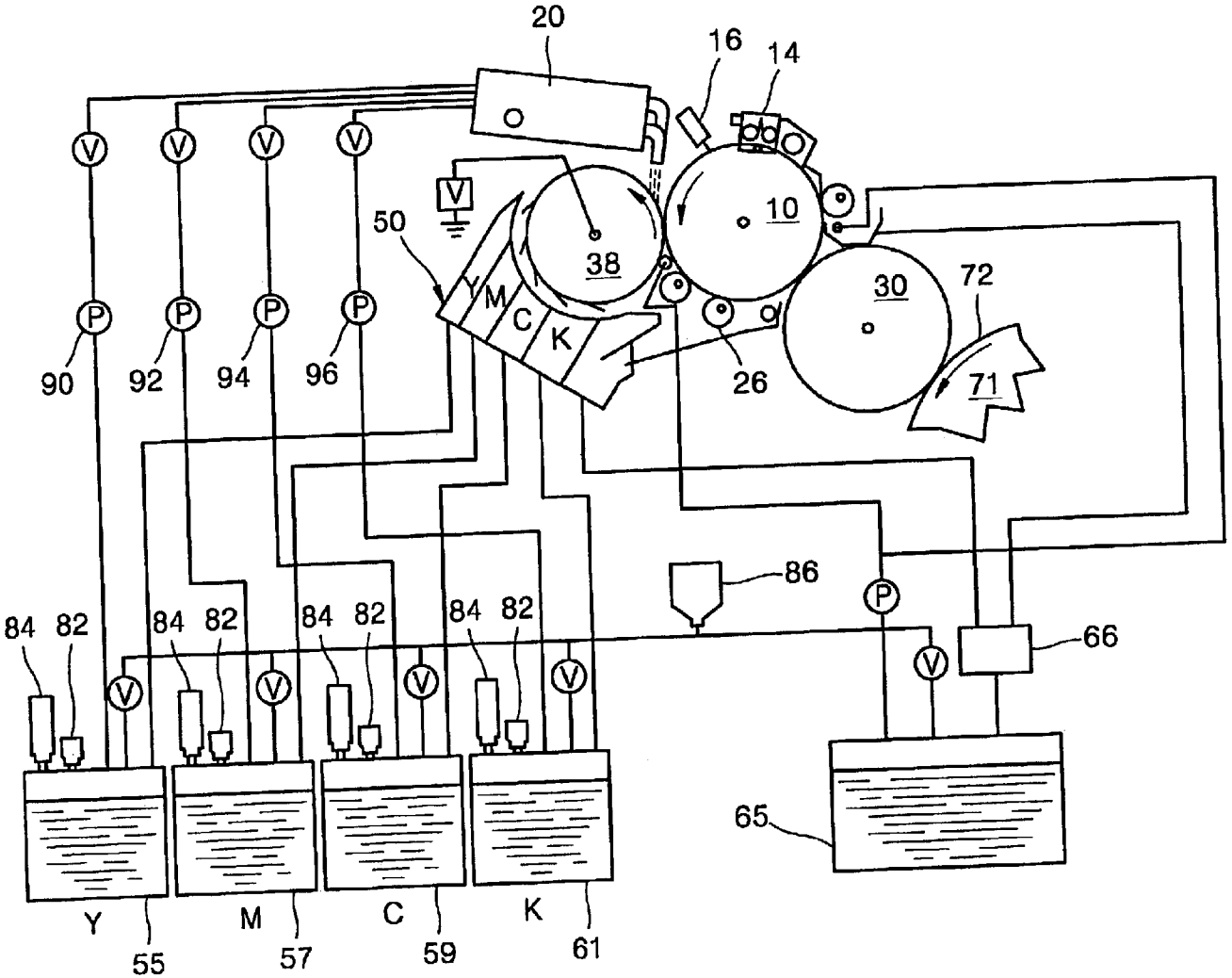
FIG. 1 (PRIOR ART)
FIG. 1 is a view of a conventional liquid developer imaging system.
Figure 2:
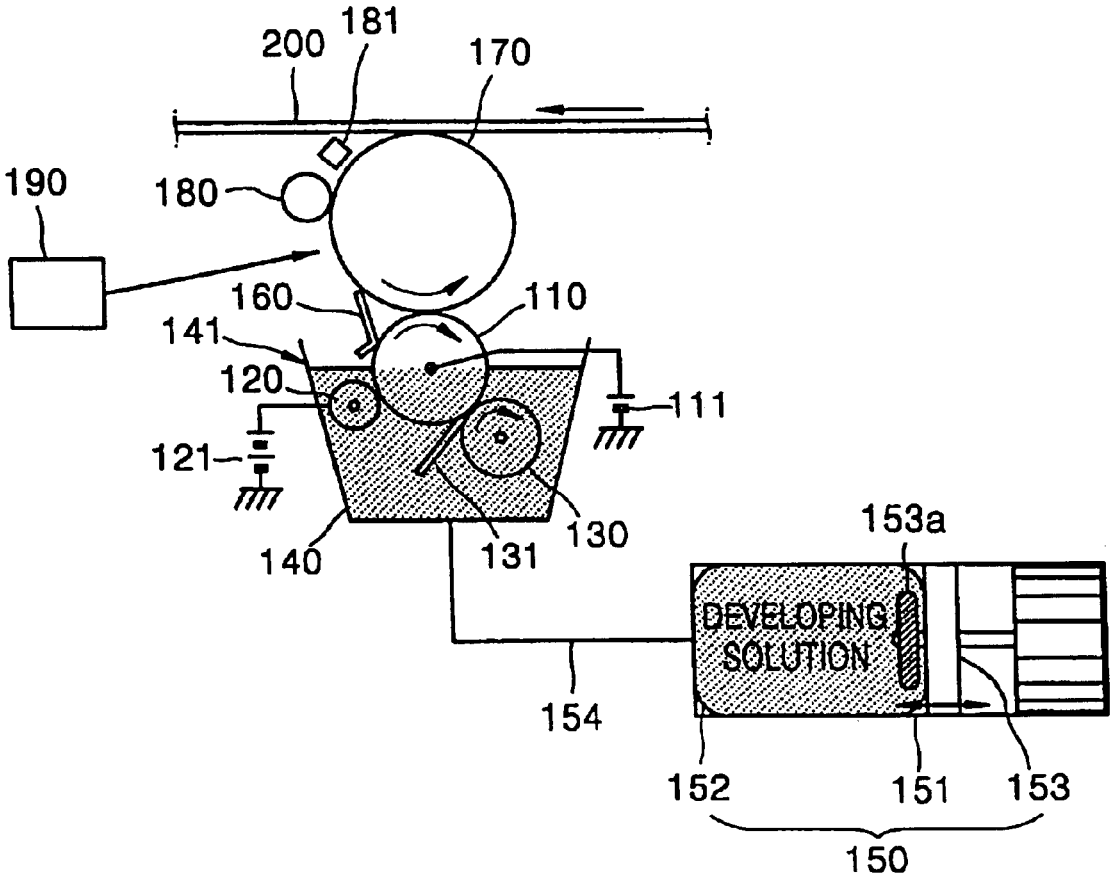
FIG. 2 is a view of a liquid developer imaging system according to the present invention.

FIG. 2 is a view of a liquid developer imaging system according to the present invention. Referring to FIG. 2, the system includes a cartridge 150 containing the developing solution and a developing container 140 for receiving the developing solution supplied from the cartridge 150. The developing solution supplied to the developing container 140 from the cartridge 150 is a high-density solution of 3 to approximately 40% solid. The cartridge 150 is composed of: a case 151; a tube 152 that is included in the case 151 and contains the developing solution; and a and forth in the case 151 and alternately to compress and expand the tube 152. When the piston 153 compresses the tube 152, the developing solution contained in the tube 152 is supplied to the developing container 140 through a predetermined supply path 154. On the contrary, when the piston 153 expands the tube 152, the developing solution in the developing container 140 is sucked into the tube 152.

The developing container 140 includes: a developing roller 110 which is rotated facing a photosensitive object 170 with a portion submerged in the developing solution; metering means such as a metering blade 160 for scraping the developing solution off the surface of the developing roller 110 to a predetermined thickness; deposit means for applying an electrical potential to the surface of the developing roller 110 so that the developing solution is easily applied to the developing roller 110; and cleaning means which cleans the surface of the developing roller 110.

The deposit means includes a deposit roller 120 which contacts with the developing roller 110, and a power supply source 121. The cleaning means comprises: a cleaning roller 130 that contacts with the developing roller 110 and is rotated in the same direction as the developing roller 110; and a cleaning blade 131, one end of which is fixedly installed to contact with the surface of the developing roller 110. The deposit roller 120 is preferably made of stainless material. Developing solution becomes attached to the developing roller 110 due to a static electricity generated by a voltage applied to the power supply source 121 by the deposit roller 120 submerged in the developing solution. At this time, the deposit roller 120 may contact with the developing roller 110 or be spaced apart therefrom by a gap of 50~200 $\mu$m (preferably, 50~100 $\mu$m). Further, the deposit roller 120 may be one of a fixed roller type or a rotating roller type or a plate type having the same curvature of the developing roller 110. The cleaning roller 130 is a sponge type and is rotated in the same direction as the developing roller 110, while contacting with the developing roller 110, thus removing particles of toner of the developing solution stained on the developing roller 110. Also, the developing roller 110 is a conductive elastomer, formed of polyurethane or NBR and preferably has a resistance of $10^5$~$10^8$ Ohms, a hardness of about 25~26 degrees as Shore A and a surface roughness of about Ra 1~4 $\mu$m.

Figure 3:
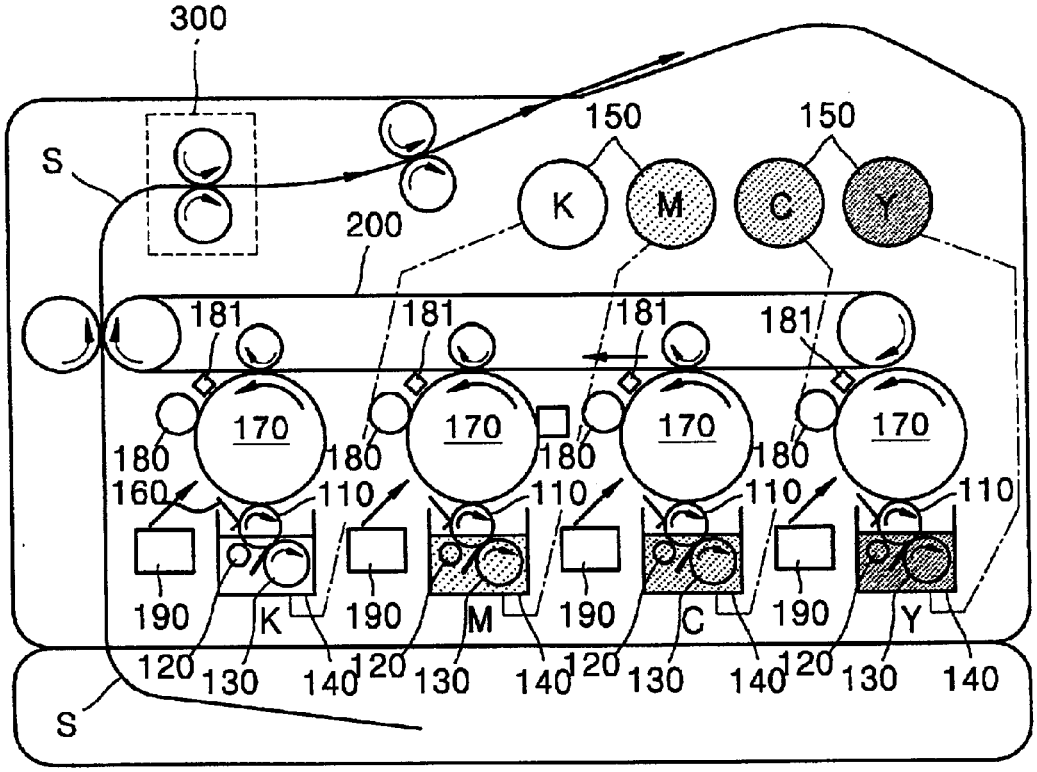
FIG. 3 is a view of the internal structure of a printer employing the liquid developer imaging system of FIG. 2.

Reference numeral '111' denotes a development power supply source, which applies a development voltage to the developing roller 110, and reference numeral '200' denotes a transferring belt that receives an image developed on the photosensitive object 170 and prints the received image on paper S (See FIG. 3). Reference numeral '180' is a charging roller for electrically charging the photosensitive object 170. Reference numeral '190' denotes an optical scanning device that scans light onto the photosensitive object 170 to form an electrostatic latent image. Reference numeral 181 denotes an electrostatic potential reset unit and reference numeral '141' denotes a level sensor.

Only one liquid developer imaging system is required in a printer using developing solution of only one color. However, four or more liquid developer imaging systems are required in a color printer that outputs a color image by overlapping images of different colors as shown in FIG. 3, i.e., one system for each color.

To develop an image with the above system, developing solution in the cartridge 150 is supplied to the developing container 140 to a predetermined level. At this time, the charged developing solution is a high-density solution of 3% to approximately 40% solid (more preferably, 3% to approximately 12% solid) as described above. Next, bias voltages of 300~550 V and 500~1550 V are applied to the developing roller 110 and to the deposit roller 120, respectively. The bias voltage applied to the developing roller 110 is approximately between 900 V (which is applied to the photosensitive object 170 by the charging roller 180) and 1000 V (which is the voltage of a portion in which an electrostatic latent image is formed by the optical scanning device 190). After the application of the bias voltage, particles of toner included in the developing solution take on a positive (+) electrical charge and therefore adhere to the surface of the developing roller 110 due to the difference in voltages between the rollers 110 and 120. At this time, some particles are strongly attached (electrically) to the surface of the developing roller 110 and some particles are weakly attached (electrically) thereto. An experiment using 3% to approximately 12% solid developing solution revealed that the developing solution which was electrically attached to the developing roller 110 due to the above difference in electrostatic potential, became 6% to approximately 14% solid with a MIA (mass/area) of 400~1100 $\mu g/cm^2$ before passing the metering blade 160. The developing solution attached to the developing roller 110 contained 6% solid, i.e., its concentration became twice as thick as that of the developing solution used, when developing solution of a comparatively low concentration, e.g., 3% solid, was used, whereas it contained the same percentage of solid or was slightly increased to 12% to approximately 14% solid when developing solution of a comparatively high concentration, e.g., 12% solid, was used. As described above, the variation in the concentration of the developing solution attached to the developing roller 110 with respect to the concentration of developing solution used is very large, and therefore, it is difficult to develop an image of regular concentration without controllling the concentration of the developing solution during the development of an electrostatic latent image on the photosensitive object 170.

Accordingly, the developing solution stained on the developing roller 110 must be scraped off by the metering blade 160 to a predetermined thickness. In the illustrative, non-limiting embodiments of the present invention, the metering blade 160 was configured by forming a metal plate of 0.005~2 mm into an 'L' shape, so that a cut thread portion thereof contacts with the developing roller 110 submerged in the developing solution. However, the shape of the metering blade 160 is not restricted and may vary so long as the metering blade 160 can scrape off the developing solution remaining on the developing roller 110. For instance, it is possible to apply a voltage to the metering blade 160, and further, it is possible to vary the pressure applied and the position and the shape of a portion of the metering blade 160 that contacts with the developing roller 110. Using the metering blade 160 and varying the parameters thereof results in a small change in the concentration and WA of the developing solution remaining on the developing roller 110. Experiments using 3~40% solid developing solution and applying a voltage to the metering blade 160 or changing the voltage, pressure, the position and the shape of a portion of the metering blade 160 contacting with the developing roller 110 revealed that the concentration of the developing solution remaining on the developing roller 110 was 18~35% solid and M/A was 150~500 $\mu g/cm^2$right before an image was developed. That is, it is possible to obtain a comparatively regular concentration distribution of the developing solution. Particularly, when a 3~12% solid developing solution was used, the concentration and M/A of the developing solution remaining on the developing roller 110 were 5.7~14% solid and 413~1126 $\mu g/cm^2$, respectively, after having been transferred directly from the deposit roller 120. In contrast, after having passed through the metering blade 160, the concentration and M/A of the developing solution were 19.6~31% solid and 220~270 $\mu g/cm^2$, respectively, right before an image was developed. At this time, a gap between the deposit roller 120 and the developing roller 110 was 70~110 $\mu m$ and the voltage difference therebetween was 500 V. In conclusion, unlike in the prior art system using developing solution of a fixed concentration, according to the present invention, a wide range of concentrations of a developing solution, e.g., 3~12% solid, can be used in the liquid developer imaging system because the concentration of the developing solution takes on a concentration value similar to the fixed concentration of the prior art system very shortly before an image is developed.

Also, the metering means is not limited to a metering blade 160, but may be, for example, a metering roller comprising a roller type member.

Figure 4:
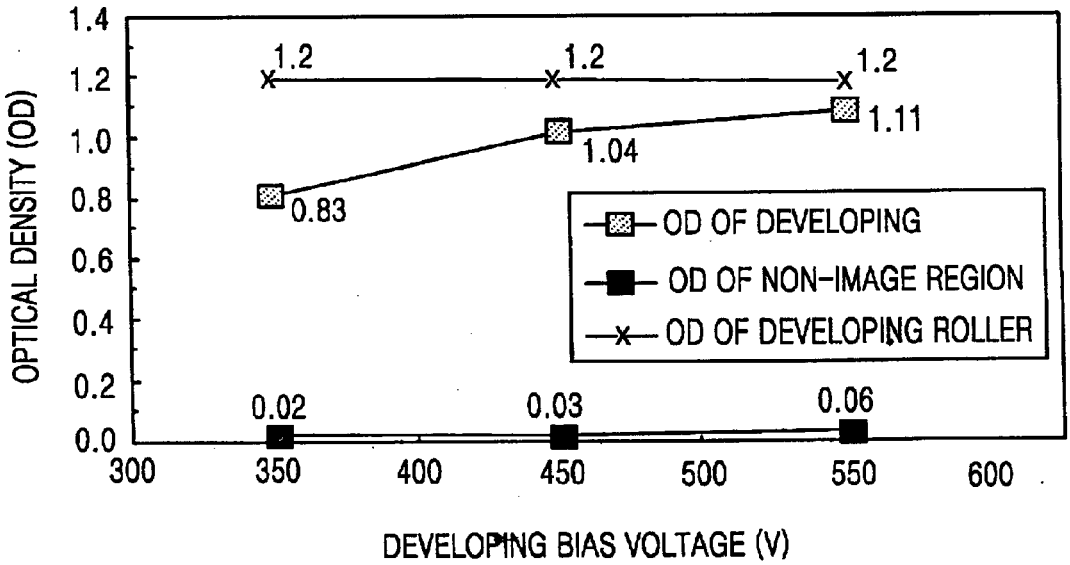
FIG. 4 is a graph showing the concentration of toner in an image obtained by the liquid developer imaging system of FIG. 2.

Thereafter, the photosensitive object 170 contacted with the developing roller 110 coated with the developing solution of the above concentration. At this time, the electrical potential of the charged photosensitive object 170 was 900 V as described above. Also, the electrical potential of a portion of the photosensitive object 170 on which an electrostatic latent image was formed was 100 V, and the moving speed of the transferring belt 200 was 3.2 inches/sec. FIG. 4 shows the optical density (OD) of developing solution and an image region and a non-image region of an image measured using a tape with respect to a developing bias voltage (V) when the photosensitive object 170 contacted with the developing roller 110. Referring to FIG. 4, the OD of the developing roller 110 was 1.2 (M/A 220 $\mu g/cm^2$) and the concentration thereof was 18% solid or more right before an image was developed. Also, as a result of changing a developing bias under these conditions, the OD of an image in an image region having an electrostatic latent image on the photosensitive object 170 was 1.11 (M/A 200 $\mu g/cm^2$), when a voltage of 550 V was applied thereto. Therefore, it is possible to obtain a favorable developing efficiency. Also, the OD of a non-image region on the photosensitive object 170 was 0.06 or less, which means the most of the non-image region was not polluted. Further, the concentration of developing solution of an image developed on the photosensitive object 170 was of a high-density, at more than 25% solid, in which no surplus solvent flowed. Therefore, the developed image is already in proper condition to be transferred without squeezing solvent out of the image, and thus, there is no need to perform a squeezing process. After the development of an image is completed, particles of toner left over are removed by the cleaning roller 130 and the cleaning blade 131 inside the developing container 140.

In the meanwhile, the developed image is transferred to the transferring belt 200 and directly printed on paper S if the colors of the image are composed only of one color. However, to realize a multi color image, images that are developed using four colors such as yellow Y, magenta M, cyan C and black K through respective image developing systems, are overlapped on the transferring belt 200, and then printed on paper S. The paper S on which the image is printed is heated and compressed by a settling unit 300 to then be output from the printer.

While the present invention has been particularly shown and described with reference to illustrative, non-limiting, embodiments thereof, it will be understood by those skilled in the art that various changes in form and details may be made therein without departing from the spirit and scope of the invention as defined by the appended claims.

The liquid developer imaging system according to the present invention has the following advantages:

(i) a high-density developing solution that is put in a cartridge can be directly supplied to a developing container without an additional dilution process. Thus, it is possible to simplify a structure for supplying developing solution to the system, thereby reducing the size of a printer;

(ii); the concentration of a developing solution coated on a developing roller can be regularly controlled using a metering blade. Further, no controller that controls the concentration of developing solution by diluting the same in a mixing tank is required, unlike in prior developing systems;

(iii) as the concentration of developing solution gets higher, spreading of a developed image can be reduced. Therefore, it is possible to obtain an image of high definition, suppressing pollution of a non-image region;

(iv) it is possible to omit a process of squeezing solvent from a developed image when a high-density developing solution is used; and (v) printing can be performed fast because dwell time is reduced by direct contact between a developing roller stained with a high-density developing solution and a photosensitive object.

What is claimed is:

1. A liquid developer imaging system comprising:

a developing container for storing a developing solution;

a developing roller with an applied bias voltage, installed for rotating facing a photosensitive object, and partly submerged in the developing solution contained in the developing container;

a deposit roller submerged in the developing solution, with a different applied bias voltage to move charged particles of the developing solution to the developing roller, so that the developing solution is applied on the developing roller; and metering means for scraping off the developing solution applied on a surface of the developing roller to a predetermined thickness.

2. The system of claim 1, wherein the developing solution is supplied via the predetermined supply line from a cartridge comprising:

a case;

a tube included in the case and containing the developing solution; and a piston for compressing and expanding the tube, where one end of the piston is combined with the tube and where the piston moves back and forth in the case.

3. The system of claim 1, wherein the deposit roller contacts the developing roller; and a power supply source is provided for applying a voltage to the deposit roller.

4. The system of claim 1, further comprising a cleaning means for cleaning the surface of the developing roller.

5. The system of claim 4, wherein the cleaning means comprises:

a cleaning roller rotating in the opposite direction from the developing roller while contacting with the developing roller; and a cleaning blade, one end of which is fixedly installed to contact with the developing roller.

6. The system of claim 1, wherein the concentration of the developing solution is 3% to approximately 40% solid.

7. The system of claim 1, wherein said metering means comprises a metering blade.

8. The system of claim 1, wherein said metering means comprises a metering roller.

9. The system of claim 1, wherein the deposit roller is fully submerged in the developing solution contained in the developing container.

10. The system of claim 5, wherein the cleaning roller and the cleaning blade are fully submerged in the developing solution.

11. The system of claim 1, wherein the deposit roller has a predetermined gap with the developing roller, and a power supply source is provided for applying a voltage to the deposit roller.

12. The system of claim 1, wherein the developing roller and the photosensitive object come into mechanical contact with each other.

13. The system of claim 1, wherein the developing roller is formed of a conductive elastomer.

14. The system of claim 1, wherein the deposit roller is spaced apart from the developing roller by a gap.

15. The system of claim 14, wherein the gap is 50–200 $\mu$m.

16. The system of claim 1, wherein the developing roller contacts the photosensitive object.

17. A method of developing a printed image using a liquid developer imaging system, the method comprising:

supplying a developing solution to a developing container;

applying a bias voltage to a developing roller, partly submerged in the developing solution contained in the developing container;

applying a different bias voltage to a deposit roller submerged in the developing solution, for moving charged particles of the developing solution to the developing roller;

scraping off to a predetermined thickness of the developing solution applied on a surface of the developing roller for controlling a concentration of the developing solution;

rotating the developing roller facing the photosensitive object for transferring the developing solution onto the photosensitive object for the development of an image;

moving a developed image onto a transfer belt; and printing the image from the transfer belt to a medium.

18. The method of claim 17, wherein the concentration of the developing solution can further be controlled by varying the pressure, position and shape of a metering unit used for scraping off the developing solution on the surface of the developing roller.

19. The method of claim 17, further comprising the step of removing the particles of toner left on the developing roller, after the development of the image is complete.

20. The method of claim 17, further comprising the step of supplying high-density developing solution from a cartridge to the developing container by a predetermined supply path.

21. The method of claim 17, further comprising:

applying a low bias voltage to the development roller, partly submerged in the developing solution contained in the developing container, and applying a high bias voltage to the deposit roller for charging particles of the toner in the developing solution.

22. The method of claim 17, wherein the developing solution has a solid concentration in the range of approximately 3 to approximately 40 percent.

23. The method of claim 17, further comprising the step of:

bringing the developing roller and the photosensitive object into mechanical contact with each other.

24. The method of claim 17, wherein the developing roller is formed of a conductive elastomer.

* * * * *